US012716157B2

(12) United States Patent
Daly et al.

(10) Patent No.: US 12,716,157 B2
(45) Date of Patent: Aug. 25, 2026

(54) LOAD DETECTION AND CYCLE MODIFICATION IN LAUNDRY APPLIANCE APPLICATIONS

(71) Applicant: WHIRLPOOL CORPORATION, Benton Harbor, MI (US)

(72) Inventors: Michael B. Daly, Watervliet, MI (US); Seth Herndon, Osceola, IN (US); Bruce M. Wiatrak, Bolingbrook, IL (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 85 days.

(21) Appl. No.: 18/568,153

(22) PCT Filed: May 31, 2022

(86) PCT No.: PCT/US2022/031574

§ 371 (c)(1),
(2) Date: Dec. 7, 2023

(87) PCT Pub. No.: WO2022/260890

PCT Pub. Date: Dec. 15, 2022

(65) Prior Publication Data

US 2024/0287722 A1 Aug. 29, 2024

Related U.S. Application Data

(60) Provisional application No. 63/208,444, filed on Jun. 8, 2021.

(51) Int. Cl.
*D06F 34/18* (2020.01)
*D06F 33/32* (2020.01)
(Continued)

(52) U.S. Cl.
CPC ..... *D06F 34/18* (2020.02); *D06F 33/32* (2020.02); *D06F 39/087* (2013.01);
(Continued)

(58) Field of Classification Search
CPC .. D06F 34/18; D06F 2103/04; D06F 2105/02; D06F 2105/58; D06F 39/087;
(Continued)

(56) References Cited

U.S. PATENT DOCUMENTS 5,259,217 A 11/1993 Civanelli et al.
6,023,950 A 2/2000 Battistella
(Continued)

FOREIGN PATENT DOCUMENTS

CN 102720037 B 1/2014
CN 102465421 B 9/2015
(Continued)

OTHER PUBLICATIONS

Chinese Office Action dated Dec. 4, 2025 for CN Application No. 2022800442438 filed Dec. 21, 2023.
(Continued)

*Primary Examiner* — Michael E Barr
*Assistant Examiner* — Lauren G Orta
(74) *Attorney, Agent, or Firm* — BROOKS KUSHMAN P.C.

(57) ABSTRACT

Inferring the laundry cycle type for a load of laundry items is provided. Measurements are performed of a laundry load in a drum of a laundry appliance during a pre-rinse cycle, the measurements including one or more of an absorption ratio of the laundry load, a retention ratio of the laundry load, a dry mass of the laundry load, a wet mass of the laundry load, or a spun mass of the laundry load. A model is used to
(Continued)

determine load parameters based on the measurements. The load parameters are used to determine a laundry cycle type for the laundry load.

19 Claims, 11 Drawing Sheets

(51) Int. Cl.

| | |
|---|---|
| ***D06F 39/08*** | (2006.01) |
| ***D06F 103/04*** | (2020.01) |
| ***D06F 103/14*** | (2020.01) |
| ***D06F 103/18*** | (2020.01) |
| ***D06F 103/38*** | (2020.01) |
| ***D06F 105/02*** | (2020.01) |
| ***D06F 105/52*** | (2020.01) |
| ***D06F 105/58*** | (2020.01) |

(52) U.S. Cl.
CPC ..... *D06F 2103/04* (2020.02); *D06F 2103/14* (2020.02); *D06F 2103/18* (2020.02); *D06F 2103/38* (2020.02); *D06F 2105/02* (2020.02); *D06F 2105/52* (2020.02); *D06F 2105/58* (2020.02)

(58) Field of Classification Search
CPC ..... D06F 2103/14; D06F 2103/18; D06F 2103/38; D06F 2105/52; D06F 33/32
See application file for complete search history.

(56) References Cited

U.S. PATENT DOCUMENTS

| | | | | |
|---|---|---|---|---|
| 7,421,752 | B2 | 9/2008 | Donadon et al. | |
| 9,139,946 | B2 | 9/2015 | Dogan et al. | |
| 9,863,076 | B2 | 1/2018 | Leonard et al. | |
| 10,145,047 | B2 | 12/2018 | Suh et al. | |
| 10,273,622 | B2 | 4/2019 | Hombroek et al. | |
| 2005/0138835 | A1 | 6/2005 | Lyu et al. | |
| 2014/0189959 | A1* | 7/2014 | Dokonal | D06F 33/32 68/12.02 |
| 2014/0250607 | A1* | 9/2014 | Favaro | D06F 33/36 8/137 |
| 2015/0072582 | A1 | 3/2015 | Wijesena et al. | |
| 2017/0145612 | A1 | 5/2017 | Zattin et al. | |
| 2017/0356116 | A1* | 12/2017 | Kwak | D06F 23/06 |
| 2018/0002856 | A1 | 1/2018 | Hombroek et al. | |
| 2018/0002857 | A1* | 1/2018 | Hombroek | D06F 35/005 |
| 2019/0390392 | A1* | 12/2019 | Lee | D06F 34/18 |
| 2021/0102332 | A1* | 4/2021 | Scheckelhoff | D06F 33/47 |
| 2021/0108350 | A1 | 4/2021 | Kwon | |

FOREIGN PATENT DOCUMENTS

| | | | |
|---|---|---|---|
| CN | 112176648 | A | 1/2021 |
| CN | 109322104 | B | 2/2021 |
| EP | 0787848 | B1 | 8/1997 |
| WO | 2016000483 | A1 | 1/2016 |
| WO | 2020050990 | A1 | 3/2020 |

OTHER PUBLICATIONS

Chinese Office Action dated May 13, 2026 for CN Application No. 2022800442438 filed Dec. 21, 2023.

Brazilian Preliminary Examination Report dated Jul. 7, 2026 for Brazilian Application No. 112023025856-1.

* cited by examiner

84

| Measurement | Absorption Ratio | Absorption Ratio | Retention Ratio |
|---|---|---|---|
| Method | $\frac{P_t - P_d}{\text{Dry Mass}}$ | $\frac{\text{Dry Mass - Wet Mass}}{\text{Dry Mass}}$ | $\frac{P_{spin}}{P_a}$ |
| Units | mmwc/kg | [] kg/kg | [] mmwc/mmwc |

FIG. 6

LOAD DETECTION AND CYCLE MODIFICATION IN LAUNDRY APPLIANCE APPLICATIONS

CROSS-REFERENCE TO RELATED APPLICATIONS

This application is the U.S. National Phase of PCT Application No. PCT/US2022/031574 filed on May 31, 2022, which claims the benefit of U.S. Provisional Application No. 63/208,444, filed on Jun. 8, 2021, the disclosures of which are hereby incorporated in their entirety by reference herein.

TECHNICAL FIELD

Aspects of the disclosure generally relate to load detection and cycle modification for laundry appliance applications.

BACKGROUND

Laundry treating appliances, such as a washing machine, have a rotating drum that defines a treating chamber in which laundry items are placed for treatment. The laundry items may include, as some examples, hats, scarfs, gloves, sweaters, blouses, shirts, shorts, dresses, socks, pants, shoes, undergarments, delicates, jackets, curtains, rugs, comforters, tablecloths, napkins, sheets, towels, and sportswear. The laundry treating appliance may have a controller that implements user-selectable, pre-programmed cycles of operation. Hot water, cold water, or a mixture thereof along with various treating chemistries may be supplied to the treating chamber in accordance with the cycle of operation. A user may select from the cycles and parameters according to the size and type of the laundry items to be treated.

SUMMARY

In one or more illustrative examples, a method for inferring the laundry cycle type for a load of laundry items is provided. Measurements are performed of a laundry load in a drum of a laundry appliance during a pre-rinse cycle, the measurements including one or more of an absorption ratio of the laundry load, a retention ratio of the laundry load, a dry mass of the laundry load, a wet mass of the laundry load, or a spun mass of the laundry load. A model is used to determine load parameters based on the measurements. The load parameters are used to determine a laundry cycle type for the laundry load.

In one or more illustrative examples, a system for inferring the laundry cycle type for a load of laundry items is provided. The system includes a sump pressure sensor, a motor; and a controller storing a model. The controller is programmed to perform measurements of a laundry load in a drum of a laundry appliance during a pre-rinse cycle, the measurements including one or more of an absorption ratio of the laundry load, a retention ratio of the laundry load, a dry mass of the laundry load, a wet mass of the laundry load, or a spun mass of the laundry load; use the model to determine load parameters based on the measurements; and use the load parameters to determine a laundry cycle type for the laundry load.

BRIEF DESCRIPTION OF THE DRAWINGS

FIG. 6 illustrates an example of three measurements of the laundry load absorption and water retention;

DETAILED DESCRIPTION

Figure 1:
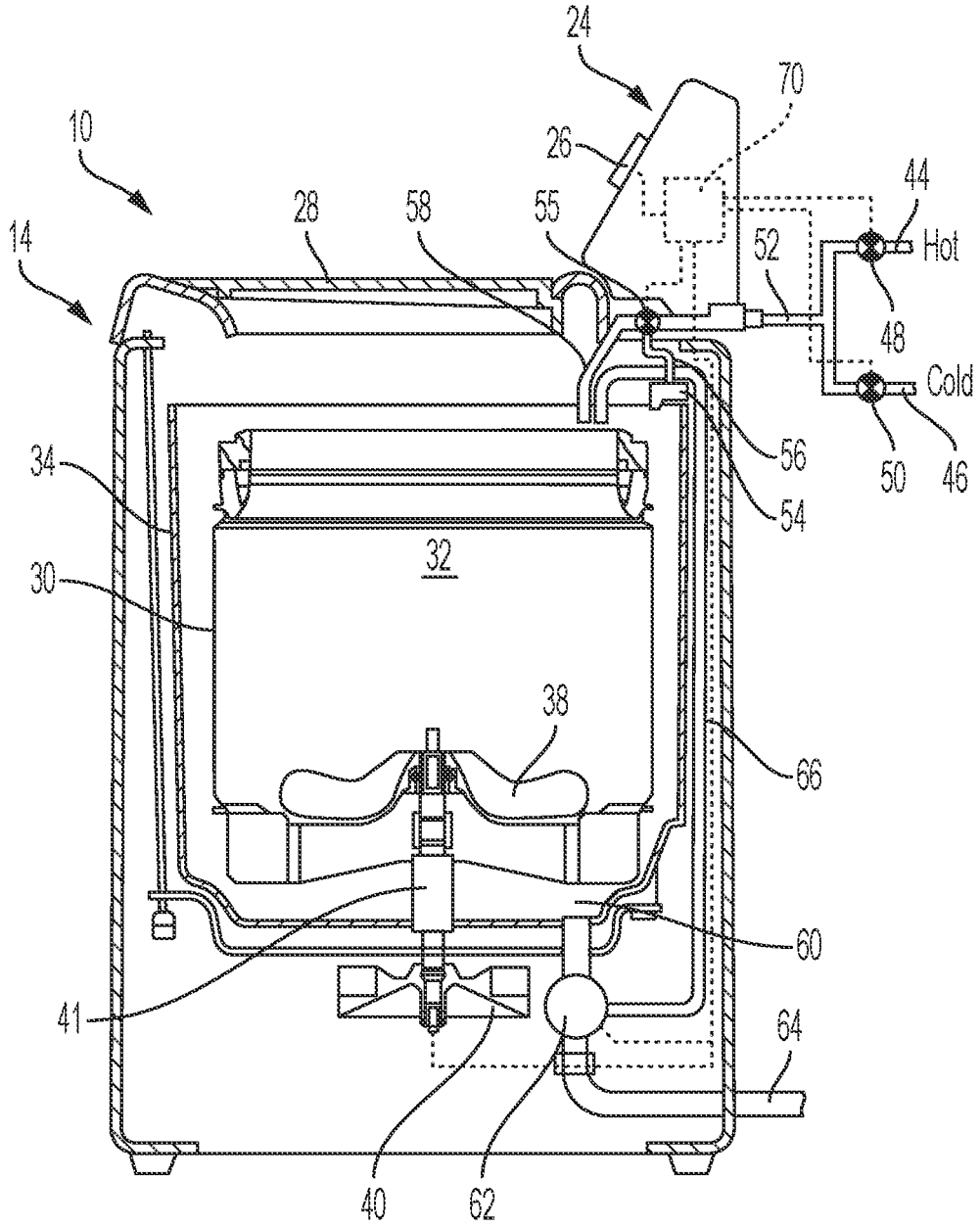
FIG. 1 illustrates a schematic cross-sectional view of a laundry treating appliance according to aspects of the present disclosure.

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

In fabric care, various variables affect the washing process for a particular load. These may include color, soil level, fabric type, and load size. Different preset cycles on a laundry treatment appliance aim to cover different spectrums on each of these variables, as different load types of laundry may benefit from using different settings. For instance, bedding, sportswear, dress clothes, and other categories of laundry items may be cleaned most effectively with unique agitation patterns, spin profiles, and water temperatures. Pre-set cycles of the laundry treatment appliance aim to accommodate the spectrum of laundry load types, organized into a few dozen options.

The laundry treatment appliance may depend on the user to select the best cycle for the submitted load. However, many users are unsure or unaware of the differences between preset cycles. Selecting the wrong cycle, particularly the wrong fabric type, can damage or wear down the clothes during the laundry treatment process or resources could be overused and wasted.

Various techniques may be used for automatically identifying load variables in a laundry treatment appliance while taking advantage of the existing hardware of the machine. These techniques may involve collecting information about the laundry load type during the laundry treatment process. For instance, tests and data collection may be performed as part of a pre-rinse routine.

The data collection may include performing a water propagation time measurement of load volume. In another example, measurements of the laundry load's absorption and water retention (e.g., absorption ratio, retention ratio) may be captured. These measurements may include, in an example, (Empty load water sump pressure−Full load water sump pressure)/Dry mass; (Dry mass−Wet mass)/Dry mass; and Spun out water sump pressure/(Empty load water sump pressure−Full load water sump pressure).

A machine learning or clustering model may be integrated into a laundry treating appliance to identify the load variables for the cycle using the collected information. Using the model, a proposed cycle for the submitted load may be determined. The model may further allow for customized cycles/settings for consumer-specific loads that aren't necessarily available for selection due to limitations in the presentation of options in the human machine interface (HMI) (e.g., low detergent, low temp water for linens).

In some examples, the model may automatically set the cycle for the laundry treating appliance. In other examples the model may confirm user-entered settings, such that if the submitted load is determined by the model to not be of the type that the user entered, a push notification may be sent to the user to allow the user to confirm and/or update the selected cycle settings.

FIG. 1 illustrates a laundry treating appliance in the form of a laundry treating appliance 10 according to one embodiment of the disclosure. The laundry treating appliance may be any machine that treats articles such as clothing or fabrics. Non-limiting examples of the laundry treating appliance may include a vertical washing machine; a combination washing machine and dryer; and a refreshing/revitalizing machine. The laundry treating appliance 10 described herein shares many features of a traditional automatic washing machine, which will not be described in detail except as for a complete understanding of the disclosure.

Washing machines are typically categorized as either a vertical axis washing machine or a horizontal axis washing machine. The "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

As further illustrated in FIG. 1, the laundry treating appliance 10 may include a housing 14, which may be a cabinet or a frame to which decorative panels may or may not be mounted. A user interface 24 may be included on the housing 14 and may have one or more knobs, switches, displays, and the like for communicating with the user, such as to receive input and provide output. A door or lid 28 may be operably coupled with the housing 14 and may be selectively moveable between opened and closed positions to close an opening in a top wall of the housing 14, which provides access to the interior of the housing 14.

A rotatable drum 30 having an open top may be disposed within the interior of the housing 14 and may define a treating chamber 32 for treating laundry. An imperforate tub 34 may also be positioned within the housing 14 and may define an interior within which the drum 30 may be positioned. The drum 30 may include a plurality of perforations (not shown), such that liquid may flow between the tub 34 and the drum 30 through the perforations. While the illustrated laundry treating appliance 10 includes both the tub 34 and the drum 30, with the drum 30 defining the laundry treating chamber 32, it is within the scope of the disclosure for the laundry treating appliance to include only one receptacle, with the receptacle defining the laundry treatment chamber for receiving the load to be treated.

A clothes mover 38 may be located in the drum 30 to impart mechanical agitation to a load of laundry placed in the drum 30. The drum 30 and the clothes mover 38 may be driven by an electrical motor 40 operably coupled with the drum 30 and clothes mover 38. A clutch assembly 41 may be provided to selectively operably couple the motor 40 with either the drum 30 and/or the clothes mover 38. The clothes mover 38 may be oscillated or rotated about its axis of rotation during a cycle of operation in order to produce high water turbulence effective to wash the load contained within the treating chamber 32. The motor 40 may rotate the drum 30 at various speeds in either rotational direction about an axis of rotation.

A liquid supply system may be provided to liquid, such as water or a combination of water and one or more wash aids, such as detergent, into the treating chamber 32. The liquid supply system may include a water supply configured to supply hot or cold water. The water supply may include a hot water inlet 44 and a cold water inlet 46, a valve assembly, which may include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 may be opened individually or together to provide a mix of hot and cold water at a selected temperature. While the valves 48, 50 and conduit 52 are illustrated exteriorly of the housing 14, it may be understood that these components may be internal to the housing 14.

As illustrated, a detergent dispenser 54 may be fluidly coupled with the conduit 52 through a diverter valve 55 and a first water conduit 56. The detergent dispenser 54 may be configured to supply and/or mix detergent to or with water from the first water conduit 56 and may supply such treating liquid to the tub 34. Water from the first water conduit 56 may also be supplied to the tub 34 through the detergent dispenser 54 without the addition of a detergent. A second water conduit, illustrated as a separate water inlet, may also be fluidly coupled with the conduit 52 through the diverter valve 55 such that water may be supplied directly to the treating chamber through the open top of the drum 30. Additionally, the liquid supply system may differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation system may be provided for recirculating liquid from the tub 34 into the treating chamber 32. More specifically, a sump 60 may be located in the bottom of the tub 34 and the liquid recirculation system may be configured to recirculate treating liquid from the sump 60 onto the top of a laundry load located in the treating chamber 32. A pump 62 may be housed below the tub 34 and may have an inlet fluidly coupled with the sump 60 and an outlet configured to fluidly couple to either or both a household drain 64 or a recirculation conduit 66. In this configuration, the pump 62 may be used to drain or recirculate wash water in the sump 60. As illustrated, the recirculation conduit 66 may be fluidly coupled with the treating chamber 32 such that it supplies liquid into the open top of the drum 30. The liquid recirculation system may include other types of recirculation systems.

Figure 2:
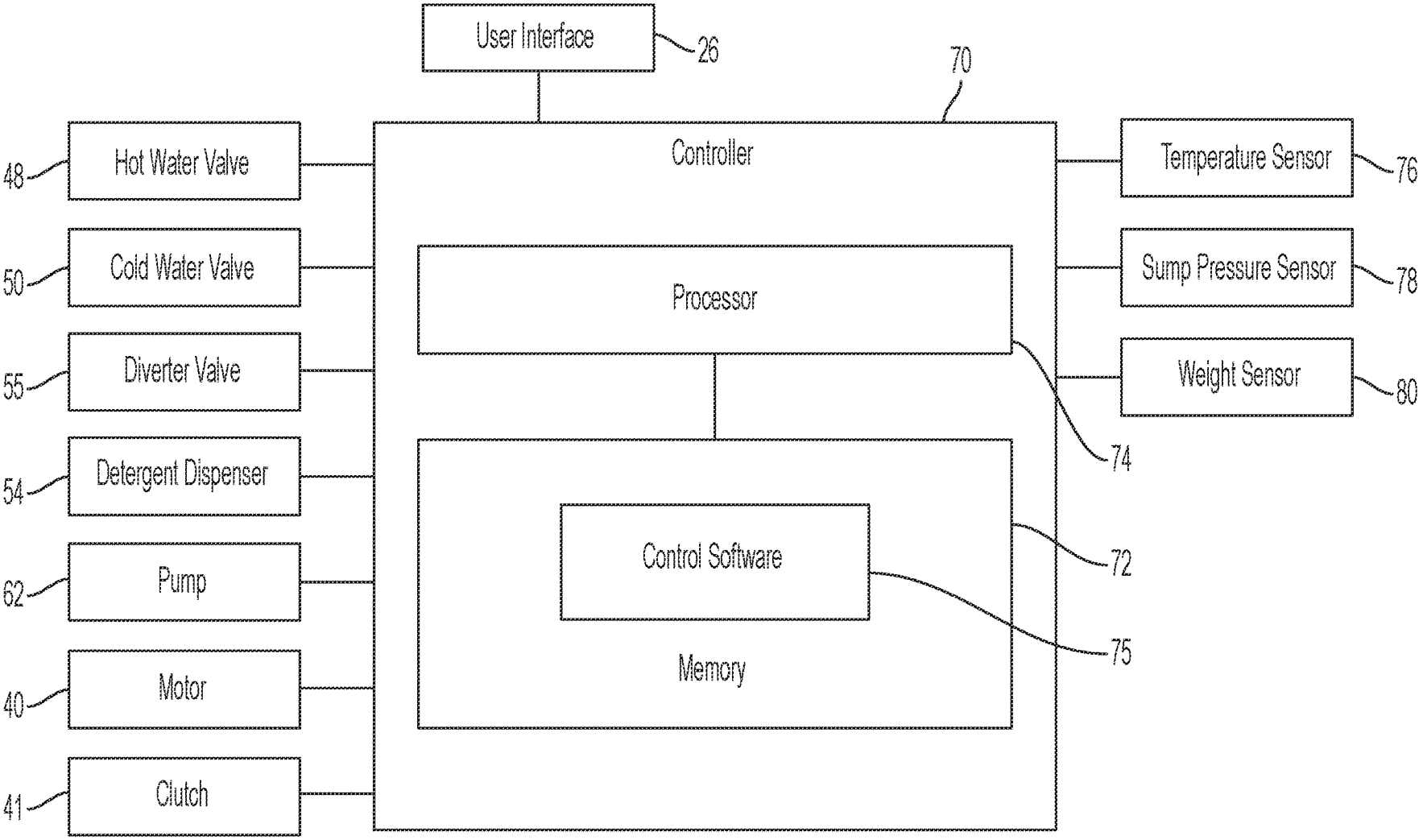
FIG. 2 is a schematic representation of a controller for controlling the operation of one or more components of the laundry treating appliance of FIG. 1.

The laundry treating appliance 10 may further include a controller 70 coupled with various working components of the laundry treating appliance 10 to control the operation of the working components. As illustrated in FIG. 2, the controller 70 may be provided with a memory 72 and a central processing unit (CPU) 74. The memory 72 may be used for storing the control software 75 that may be executed by the CPU 74 in completing a cycle of operation using the laundry treating appliance 10 and any additional software. The memory 72 may also be used to store information, such as a database or machine-learning model or data cluster, as well as information received from the one or more components of the laundry treating appliance 10 that may be communicably coupled with the controller 70.

The controller 70 may be operably coupled with one or more components of the laundry treating appliance 10 for communicating with and/or controlling the operation of the components to complete a cycle of operation. For example, the controller 70 may be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; the motor 40 and clutch assembly 41 for controlling the direction and speed of rotation of the drum 30 and/or the clothes mover 38; and the user interface 24 for receiving user selected inputs and communicating information to the user.

The controller 70 may also receive input from a temperature sensor 76, such as a thermistor, which may detect the temperature of the treating liquid in the treating chamber 32 and/or the temperature of the treating liquid being supplied to the treating chamber 32. The controller 70 may also receive input from a sump pressure sensor 78, such as a diaphragm which bends as pressure is applied to generate an electrical signal in proportion to the pressure. The controller 70 may also receive input from various additional sensors. Non-limiting examples of additional sensors that may be communicably coupled with the controller 70 include: a weight sensor 80 configured to measure the mass of laundry items in the tub 34, and a torque sensor of the motor 40 configured to measure the torque of the motor 40.

The laundry treating appliance 10 may perform one or more manual or automatic treating cycles or cycle of operation. A common cycle of operation includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include one or more of these exemplary phases. Generally, in normal operation of the laundry treating appliance 10, a user may select a cycle of operation via the user interface 24. Non-limiting examples of cycles of operation include a normal cycle, a delicate cycle, and a heavy-duty cycle.

Figure 3:
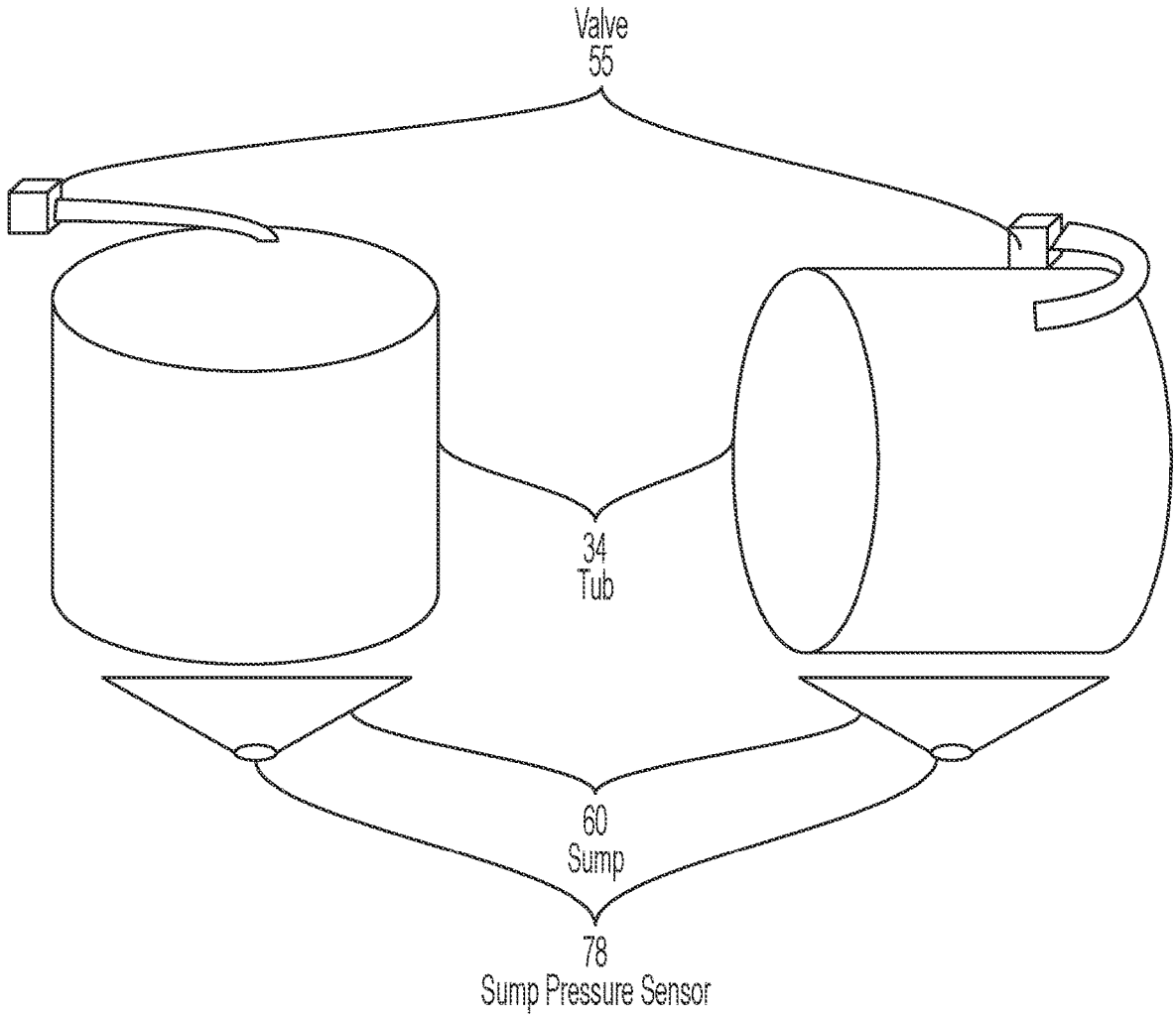
FIG. 3 illustrates the tub and relative locations of a main wash valve, here the diverter valve, and the sump pressure sensor.

FIG. 3 illustrates the tub 34 and relative locations of a main wash valve, here the diverter valve 55, and the sump pressure sensor 78. This is shown, in the illustrated example, for an example top load laundry treating appliance 10 (left) and for an example front-load laundry treating appliance 10 (right). An approach for measuring relative absorption of fabric in a washing machine drum may be performed by the controller 70 controlling the diverter valve 55 and using input from the sump pressure sensor 78. In conjunction with an estimation of mass, the absorption metric can be used to estimate fabric type and inform decisions with respect to the laundry cycle, such as detergent volume, water temperature, and maximum spin speed.

The approach to measuring absorption utilizes control and feedback from the valve 55 and the sump pressure sensor 78. The valve 55 may be actuated to add a consistent volume of water to the tub 34. The sump pressure sensor 78 may provide a measurement of pressure (e.g., in millimeter-water-column (mmwc)), in the bottom of the sump 60, where the liquid in the laundry treating appliance 10 drains before being evacuated by the pump 62.

Figure 4A:
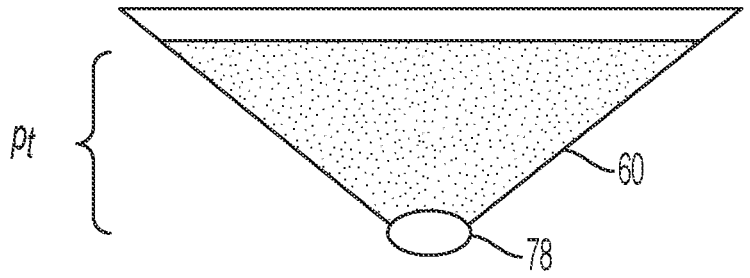
FIGS. 4*a*-4*c* collectively illustrate a pressure calculation based on measurements from the sump pressure sensor.
Figure 4B:
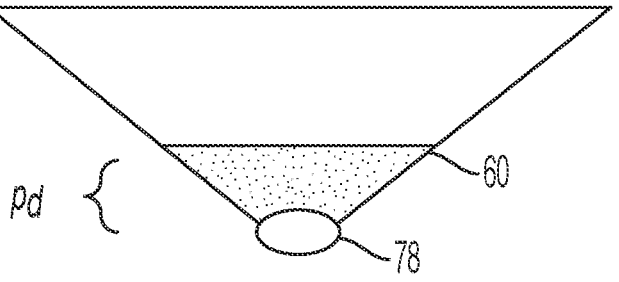
Figure 4C:
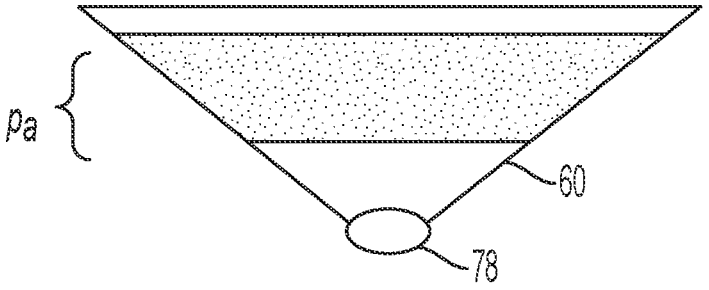

FIGS. 4*a*-4*c* collectively illustrate a pressure calculation based on measurements from the sump pressure sensor. $P_t$ refers to the pressure recorded when the water dispensed into the tub 34 collects in the sump, which occurs when the tub 34 is empty or contains a completely non-absorbent fabric, such as a raincoat. A measurement of $P_t$ is shown at FIG. 4*a*. $P_d$ refers to the pressure recorded from whatever water collects in the sump after being added to a tub 34 containing fabric with some absorbency. A measurement of $P_d$ is shown at FIG. 4*b*. The difference between $P_t$ and $P_d$ is $P_a$, which represents the volume of the water that is absorbed by the fabric in the tub 34.

To compute these measures, responsive to initiation of the cycle a mass estimation routine is executed to obtain a measurement of the dry mass of the laundry items. Then, the valve 55 is opened for a set number of seconds, allowing a prescribed volume of water to enter the drum 30 while it is spinning at a slow (<25 rpm), constant speed. After the valve 55 is shut off, the residual water is allowed to drain to the sump 60. Before the sump 60 is drained, the maximum pressure is recorded (i.e., $P_d$). This maximum pressure, when subtracted from the pressure caused by dispensing the same volume of water into an empty drum 30 (i.e., $P_t$), describes the amount of water that is initially absorbed by the laundry items in the drum 30. Any water that is not observed in the sump 60 is assumed to be trapped within the laundry items (i.e., $P_a$). A computation of $P_a$ is shown at FIG. 4*c*.

After the excess water is drained, the mass estimation routine is repeated, this time to measure the wet mass of the laundry items. During this measurement, some water that was trapped, but not absorbed into the laundry items may drain to the sump 60. Both the pressure of any residual water in the sump 60 and the wet mass estimation may be recorded, e.g., to the memory 72. Thus, two measurements of water absorbed by the laundry items of the load are accessible: (1) the difference between the wet and dry load masses, and (2) the difference between the volume of water added to the drum 30 and what was drained, as measured by the sump pressure sensor 78.

Figure 5:
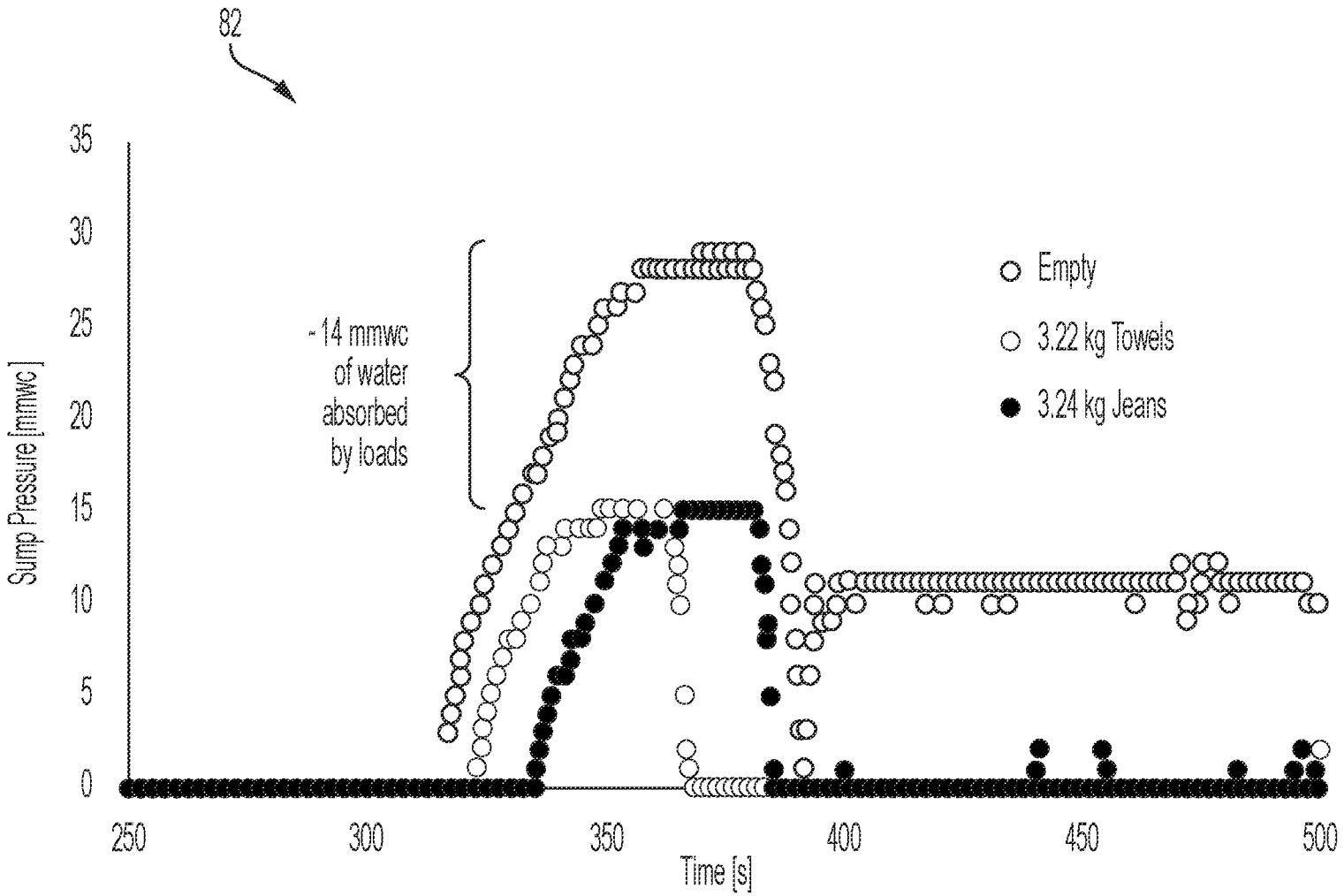
FIG. 5 illustrates pressure sensor curves for identical cycles with three different types of laundry item contents of the drum.

FIG. 5 illustrates a graph 82 of pressure sensor curves for identical cycles with three different types of laundry item contents of the drum 30. As shown, the Y-Axis of the graph 82 is sump pressure as measured by the sump pressure sensor 78, and the X-Axis is time in seconds. The peak of the top (blue) curve shows that the amount of water added to the system at empty results in 29 mmwc of pressure on the sump pressure sensor 78. Similar masses of jeans and towels, both composed of heavy, absorptive cotton fabrics, absorb similar amounts of water, allowing 15 mmwc to reach the sump 60.

As further shown, the drum 30 is driven by the motor 40 to accelerate the laundry items to a rotational speed (e.g., exceeding 400 rpm), thereby extracting water from the laundry items. This water similarly accumulates in the sump 60, and may be measured before draining by the sump pressure sensor 78 (this measure may be referred to as $P_{spin}$). The amount of water extracted, as a proportion of the amount of water initially absorbed, may be a measure of moisture retention capacity of the laundry items, a related, but distinct property.

FIG. 6 illustrates an example 84 of the three measurements of the laundry load absorption and water retention generated using the described approach. A first of these measurements may include an absorption ratio of the laundry items, which may be computed as $$\frac{P_t - P_d}{\text{dry mass}},$$

where $P_t$ and $P_d$ are computed as shown in FIGS. 4*a*-4*b* and the dry mass as initially measured. A second of these measurements may include an absorption ratio of $$\frac{\text{dry mass} - \text{wet mass}}{\text{dry mass}},$$

where the dry mass is as initially measured before the determination of $P_t$ and $P_d$ and the wet mass is as measured after. A third of these measurements may include a retention ratio, which may be computed as $$\frac{P_{spin}}{P_a},$$

where $P_a$ is computed as shown in FIG. 4*c* and $P_{spin}$ is computed resulting from the spin cycle discussed with respect to FIG. 5.

The first absorption ratio (left) may be in terms of units of mmwc/kg. The second absorption ratio (center) and retention ratio (right) may be unitless. The map of ranges of each of these values for their corresponding fabric types is in development. These measurements may be divided by dry load mass of the laundry items to calculate the specific (per unit mass) properties. These metrics for absorption can be passed to a model, such as a clustering algorithm (discussed in further detail below) that outputs the most likely fabric type given a set of absorption and retention parameters. For example, a load of 3 kg of synthetic dress shirts would have lower absorption and retention ratios than 3 kg of towels.

Thus, as opposed to other approaches that may rely on a user or other technology to submit fabric type information to the washing machine, the disclosed approach uses three novel measurements to generate representative parameters for load absorption, and indirectly, fabric type. Moreover, the absorption tests and data collection may be embedded within the pre-rinse routine as part of a normal wash cycle. The water added and drained from the drum 30 while absorption is measured may be used as part of the pre-rinse phase of the wash process, thereby avoiding wasting water.

In another aspect of the disclosed approach, additional techniques may be used for collecting information about the laundry load type during the wash process. As the laundry treating appliance 10 spins the load, a machine learning algorithm may estimate the initial mass (before water is added) based on feedback from the motor 40 (e.g., voltage, current, torque, speed, etc.). If any water is observed in the sump 60 via the sump pressure sensor 78 during initial spins, the amount may be recorded as an equivalent pressure in mmwc before being evacuated from the system by the sump pump 62. Then, when water is added, the time between the valve actuation and the moment water reaches the sump 60 may be recorded.

Figure 7:
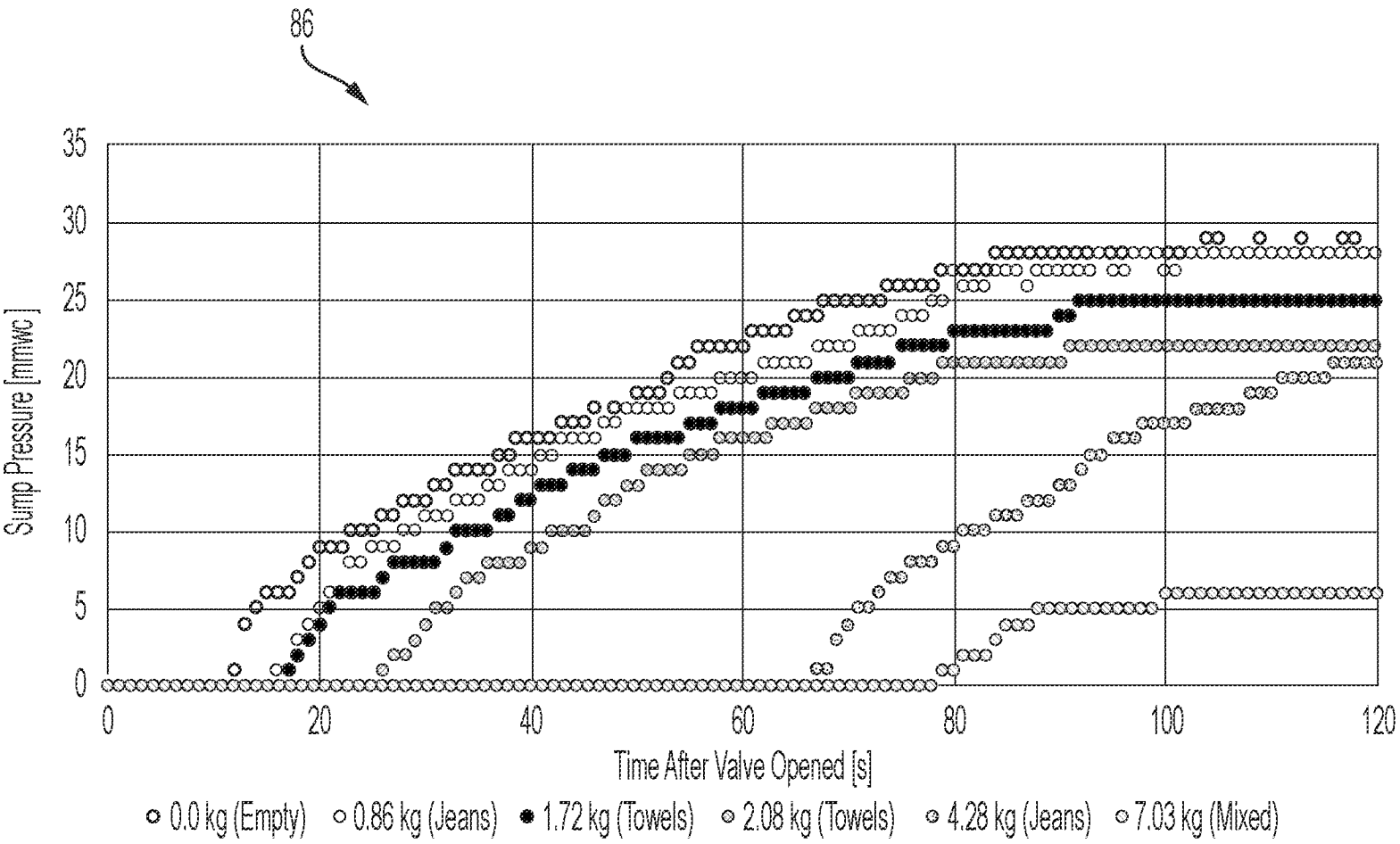
FIG. 7 illustrates a graph of the time for water to reach the sump pressure sensor after the valve is opened in the laundry treating appliance.

FIG. 7 illustrates a graph 86 of the time for water to reach the sump pressure sensor 78 after the valve 55 is opened in the laundry treating appliance 10. As shown, the Y-Axis is sump 60 pressure as measured by the sump pressure sensor 78, while the X-Axis is time in second after the opening of the valve 55. A plurality of traces are shown on the graph 86 for different weights and types of laundry items.

Generally, time is positively correlated with load size. In FIG. 7, load size is described by mass (e.g., kg), but the water propagation time may be more representative of volume. The measure of the time it takes for the water to propagate through the laundry items to the sump 60 is related to the amount of material in the drum 30, as it takes longer for water to propagate through more fabric. As the time is principally related to the volume of the load of laundry items in the drum 30, the time may be used to estimate the density of the load fabric.

After the water is added, the amount of water the laundry load absorbed is measured. Similar to as discussed above, this may be done by measuring the initial mass before applying the water, estimating the wet mass, and subtracting the initial mass. The wet mass may be estimated by adding a defined quantity of water to the drum 30 and measuring the amount of water that drains to the sump 60 using the sump pressure sensor 78. Once measured, the load may be spun out, and the water retention of the load may similarly be quantified based on the additional water that drains to the sump 60 using the sump pressure sensor 78.

Figure 8:
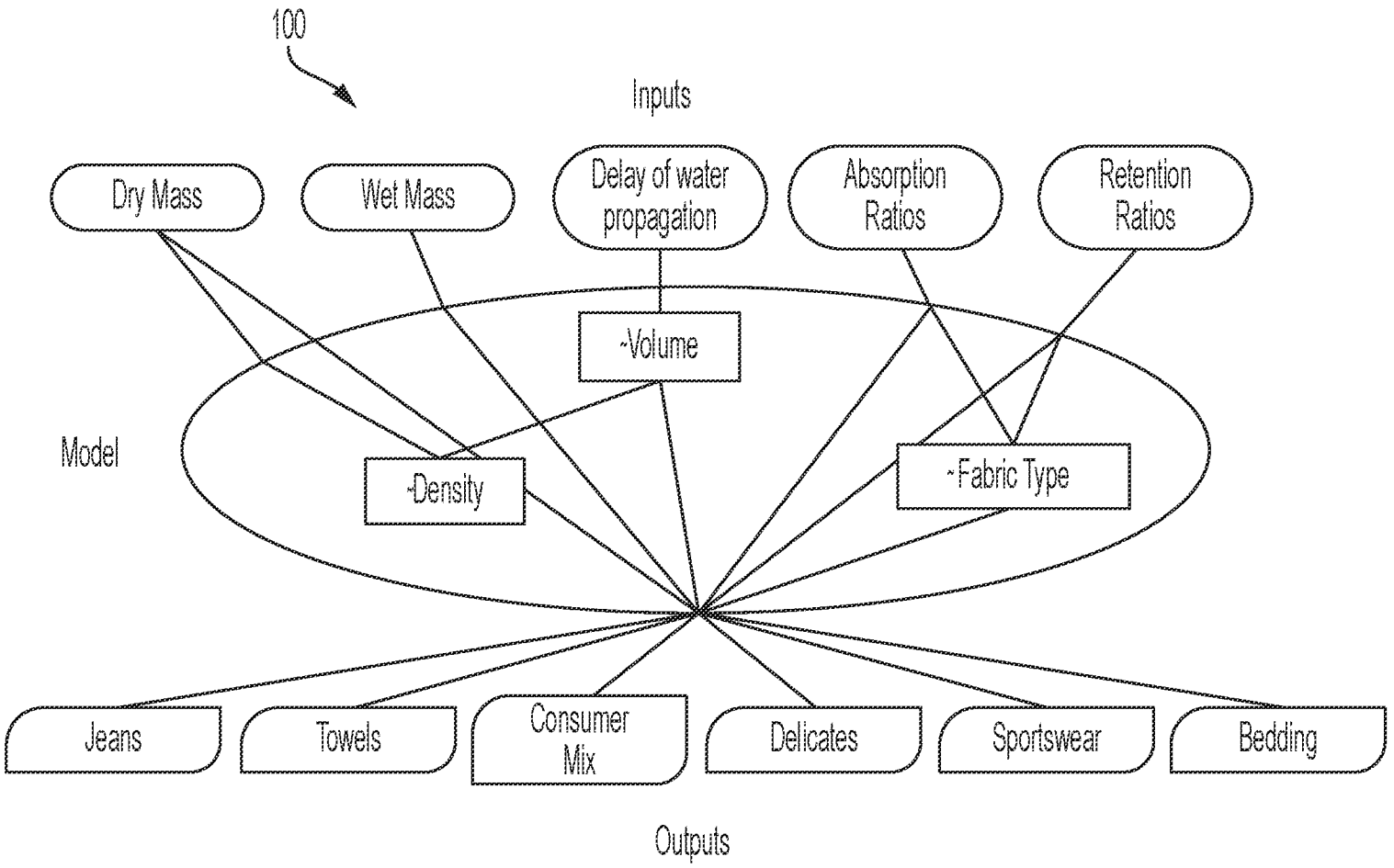
FIG. 8 illustrates a diagram of a classifier machine learning model for use in the described data collection and prediction.

FIG. 8 illustrates a diagram of a classifier machine learning model 100 for use in the described data collection and prediction. As shown the model 100 receives inputs collected during the wash process and outputs a prediction for load type. The input values may affect the output class directly, or through intermediate parameters, such as those shown within the model (e.g., volume, density, fabric type).

In an example the inputs may include one or more of dry mass of the laundry items in the drum 30, the wet mass of the laundry items in the drum 30, the delay of water propagation as shown in FIG. 7, absorption ratios such as those shown in FIG. 6, and/or the retention ratio as shown in FIG. 6. The outputs of the model 100 may include an indication of the probable type or types of laundry items in the drum 30.

In an example, the model 100 may utilize an unsupervised learning approach, such as clustering, to draw inferences and find patterns from input data without references to labeled outcomes. In a clustering approach, data elements are grouped using one or more cluster locating techniques. These techniques may include, in an example k-means clustering using a distance measure defined for the data space of the input variables. These clusters may each be associated with a type of laundry item, such that inputs consistent with a cluster may be inferred to be associated with that same type of laundry item. It should be noted that this is an example, and other clustering approaches may be used such as hierarchical clustering or mean-shift clustering. Using such an approach the input measurements may be groups into clusters that are each indicative of a different type of laundry load.

Figure 9:
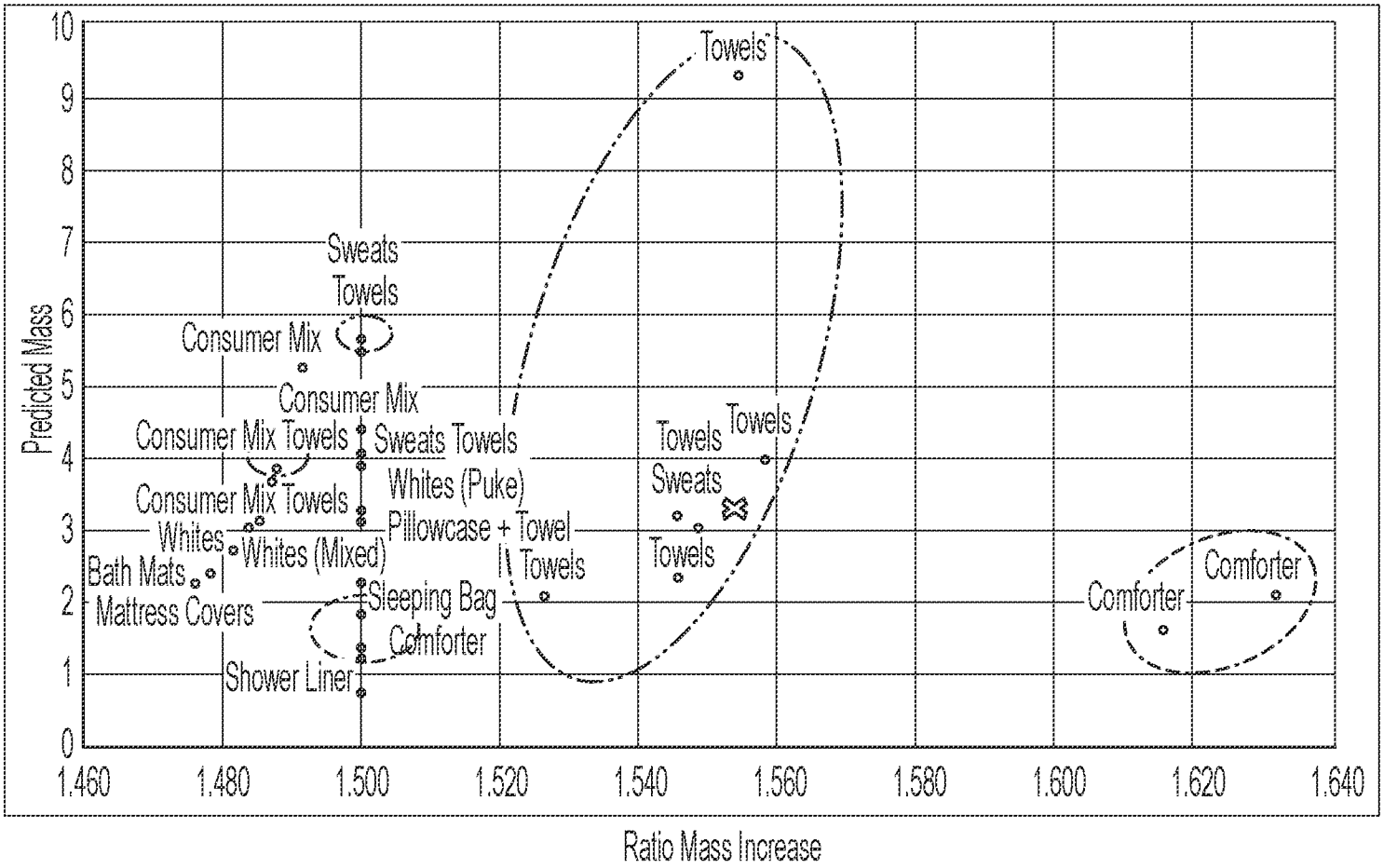
FIG. 9 illustrates a distribution of data along the axes of load mass and relative load absorption.

FIG. 9 illustrates a distribution of data along the axes of load mass and relative load absorption. Some clustering is evident, as two of three comforters tested were easily distinguishable on two axes, and five of seven loads of towels were also clustered, with one false positive (sweats).

In another example, the model 100 may be a supervised machine learning model using a neural network. The neural network may include one or more layers, such as an input layer that receives the inputs, one or more hidden layers, and an output layer that provides the outputs. Each node in the neural network may compute an output value by applying a specific function to the input values received from a previous layer, where the function applied to the input values is determined by a vector of weights and a bias. As opposed to the clustering approach, the weights of model 100 may be adjusted in a training phase using a mapping of input values to output values, where the model 100 may then be used in an inference phase to provide correct output values for runtime input values.

Regardless of the type of model 100 employed, the model 100 may make a determination of the load type. In an example, this determination may be used to control the wash cycle of the laundry treating appliance 10. For instance, the controller 70 may access a lookup table of cycles stored to the memory 72 based on the load parameters. For a load type of towels, a cycle for towels may be inferred, while for a load type of delicates, a delicate cycle may be inferred.

In another example, the determination may be used to validate that a user-selected cycle is appropriate for the laundry items in the drum 30. For instance, if the load type is determined by the model 100 that differs from the cycle selection made by the user, a notification may be delivered to the user requesting confirmation. An example notification may say "Delicates were detected in the washing machine. Would you like to switch to a gentler cycle to protect them?"

In another example, the determination may be used to provide information to other connected appliances beyond the laundry treating appliance 10. For instance, information with respect to load size and relative absorption may be relayed to a connected dryer. Large, absorptive loads such as towels take much more heat and longer times to dry, so they should be spun out for longer at higher speeds while in the washing machine to save energy across the overall system. However, synthetic fabrics found in dress clothes and underwear tend to be less absorptive and potentially harmed by high temperatures or faster spin speeds.

Figure 10:
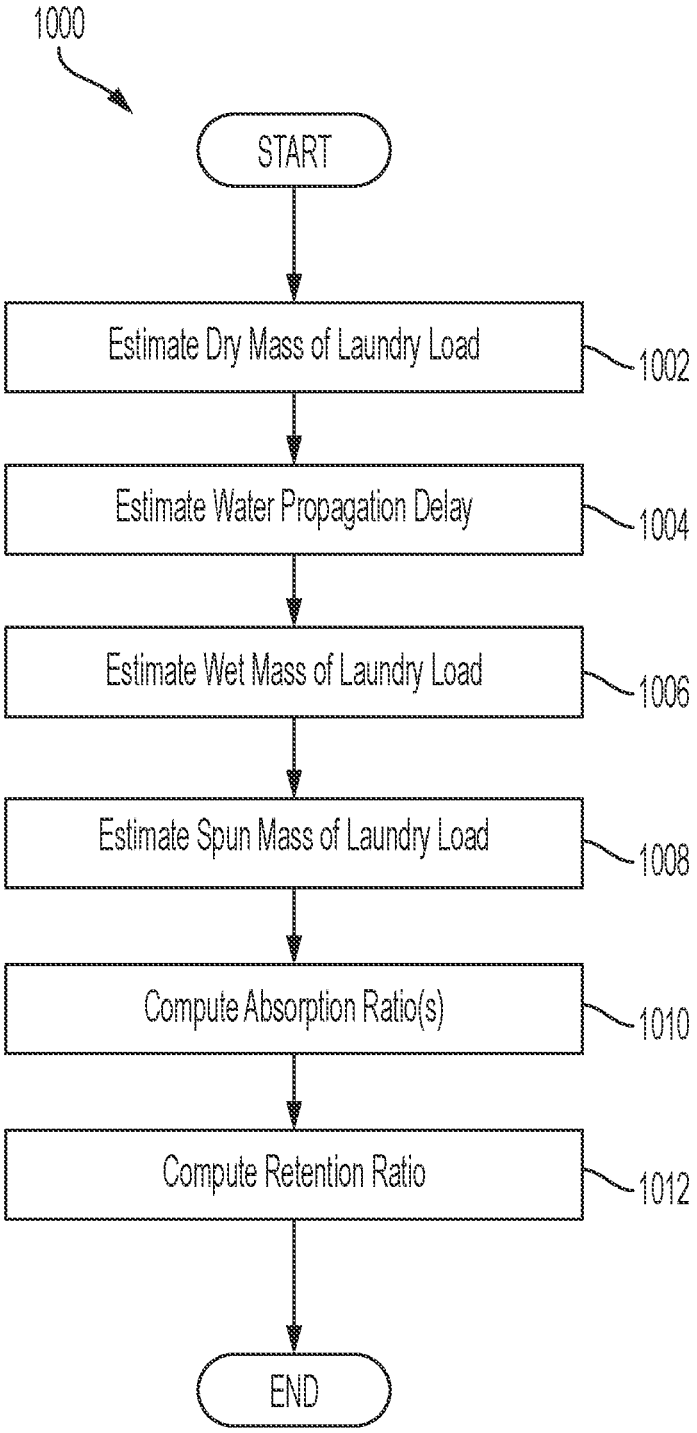
FIG. 10 illustrates an example process for performing measurements of the laundry load items in a pre-rinse routine.

FIG. 10 illustrates an example process 1000 for performing measurements of the laundry load items in a pre-rinse routine. In an example, the process 1000 may be performed by the control software 75 of the controller 70 of the laundry treating appliance 10.

At operation 1002, the controller 70 estimates the dry mass of the laundry load. In one example, the controller 70 may utilize a weight sensor to directly measure the mass of laundry items in the tub 34. In another example, the controller 70 may spin the tub 34 and may measure data from a torque sensor of the motor 40 to estimate the mass.

At operation 1004, the controller 70 estimates the water propagation delay of the laundry load. In an example, the controller 70 may direct the valve 55 to open for a set number of seconds, allowing a prescribed volume of water to enter the drum 30 while it is spinning at a slow (<25 rpm), constant speed. The controller 70 may then shut the valve 55. The controller 70 may record the sump pressure sensor 78 over time.

At operation 1004, the controller 70 estimates the wet mass of the laundry load. In an example, the controller 70 may utilize the maximum recorded sump pressure sensor at operation 1004 (i.e., $P_d$). The controller 70 may also estimate the retained water $P_a$ as the difference of $P_t - P_d$.

At operation 1006, the controller 70 estimates the spun mass of the laundry load. In an example, the controller 70 directs the motor 40 to accelerate the laundry items to a rotational speed to extract water from the laundry items and measures the sump pressure sensor 78 of the water that was spun out. This measure may be referred to as $P_{spin}$.

At operation 1008, the controller 70 computes absorption ratios for the laundry load. A first of these measurements may include an absorption ratio of the laundry items, which may be computed as $$\frac{P_t - P_d}{\text{dry mass}},$$

where $P_t$ is predefined. A second of these measurements may include an absorption ratio of $$\frac{\text{dry mass} - \text{wet mass}}{\text{dry mass}}.$$

At operation 1010, the controller 70 computes a retention ratio for the laundry load. The retention ratio may be computed as $$\frac{P_{spin}}{P_a}.$$

After operation 1010, the process 1000 ends.

Figure 11:
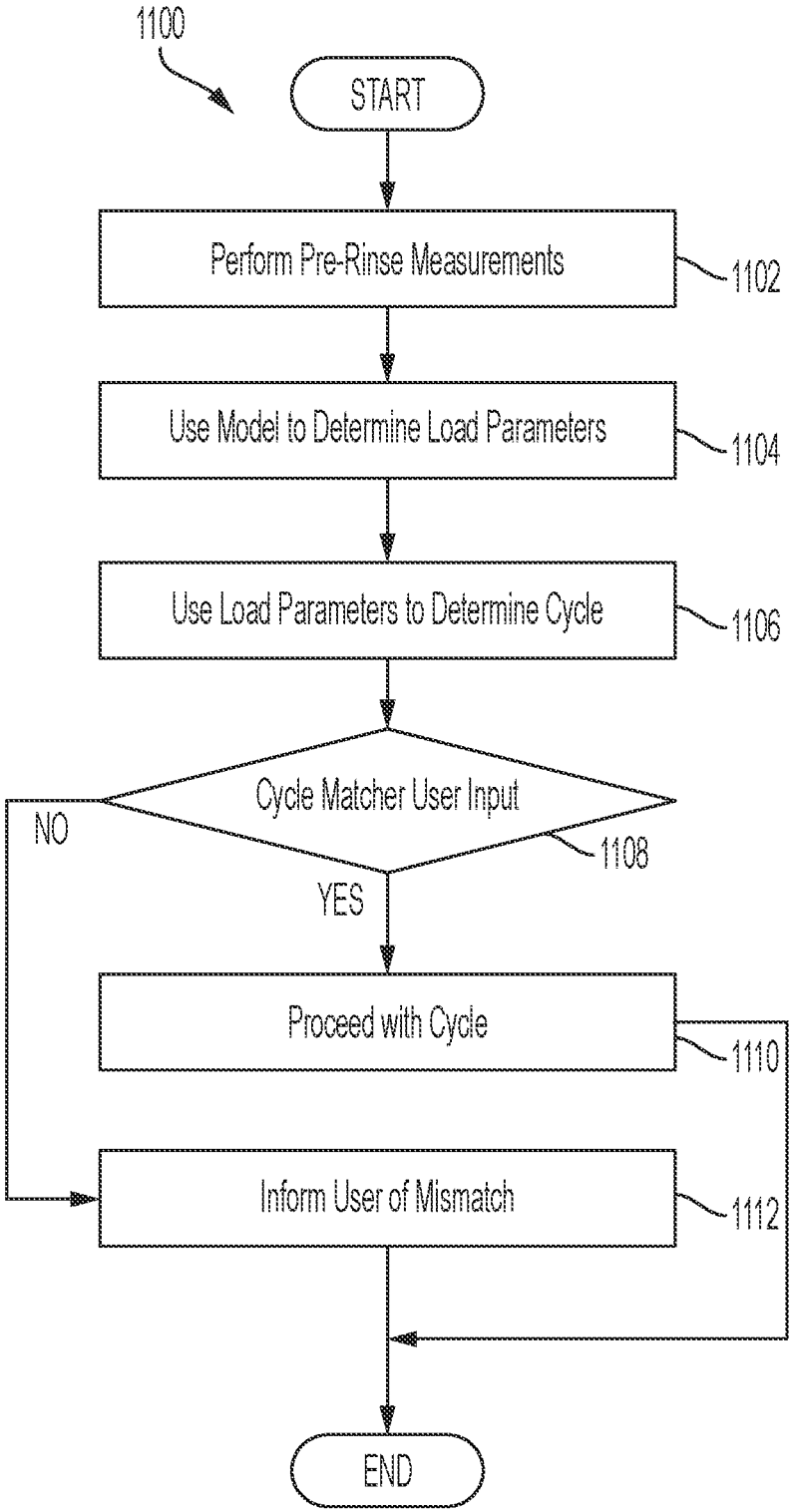
FIG. 11 illustrates an example process for the use of the model to infer a load information for the laundry treatment appliance.

FIG. 11 illustrates an example process 1100 for the use of the model 100 to infer load information for the laundry treating appliance 10. In an example, as with the process 1000 the process 1100 may be performed by the control software 75 of the controller 70 of the laundry treating appliance 10.

At operation 1102, the controller 70 performs pre-rinse measurements. In an example, the controller 70 may direct the laundry treating appliance 10 to perform the operations of the process 1000 discussed in detail above. As some examples, this may include one or more of dry mass of the laundry items in the drum 30, the wet mass of the laundry items in the drum 30, the delay of water propagation, absorption ratios, and/or retention ratio.

At operation 1104, the controller 70 uses the model 100 to determine load parameters. In an example, the model 100 may determine the load type as discussed above with respect to FIGS. 8-9. At operation 1106, the controller 70 uses the determined load type to determine the preferred cycle type for the load. For instance, the controller 70 may access a lookup table of cycles based on the load parameters. In an example, for a load type of towels, a cycle for towels may be inferred, while for a load type of delicates, a delicate cycle may be inferred.

At operation 1108, the controller 70 determines whether the determined type of cycle matches user input of the type of cycle. In an example, controller 70 may have received input to the user interface 24 from the user of a cycle to perform on the laundry items. This cycle may or may not match the cycle determined at operation 1104 using the model 100. If these cycles are consistent, control passes to operation 1110 to proceed with the cycle. After operation 1110, the process 1100 ends.

If not, then control passes to operation 1112 for the controller 70 informs the user of the mismatch. In an example, the controller 70 may sound an alarm or show a message on the user interface 24 indicating the mismatch in cycle. In another example, if the controller 70 has wireless communication capability, the controller 70 may send the message to a mobile device of the user. Regardless of approach, the user may be able to adjust the cycle (or choose not to adjust the cycle) responsive to the notification of the mismatch. If the user chooses to change the cycle type, then the cycle proceeds with the changed cycle type. If not, then the cycle proceeds with the originally selected cycle type. After operation 1112, the process 1100 ends.

Thus, an integrated machine learning model 100 may be used to measure load type into the wash cycle. By using objective, data-driven inputs, extra user steps such as scanning the laundry load may be avoided. Moreover, using water-propagation time measurement of load volume helps solve for fabric density, which is useful for identifying fabric type, and may be more effective than using mass or intertie of the load. Moreover, the model 100 may allow for the use of customized cycles/settings for consumer-specific loads that aren't necessarily programmed into the HMI (e.g., low detergent, low temp water for linens). Accordingly, the disclosed approaches provide a greater range of options than can be conveniently arranged on a dial or HMI.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for inferring a laundry cycle type for a load of laundry items, comprising:

performing measurements of a laundry load in a drum of a laundry appliance during a pre-rinse cycle, the measurements including a dry mass of the laundry load, a wet mass of the laundry load, a spun mass of the laundry load, and time, the performing including estimating the dry mass of the laundry load, adding water into the drum, measuring a time between adding the water and the water reaching a sump of the laundry appliance, estimating the wet mass of the laundry load in comparison to the dry mass, spinning out the laundry load, and estimating the spun mass of the laundry load in comparison to the dry mass;

using a model to determine load parameters based on the measurements; and using the load parameters to determine a laundry cycle type for the laundry load.

2. The method of claim 1, further comprising:

receiving an input cycle type from a user interface of the laundry appliance;

proceeding with the input cycle type responsive to the input cycle type and the determined laundry cycle type being a match; and displaying a notification on the user interface responsive to a mismatch between the input cycle type and the determined laundry cycle type.

3. The method of claim 1, further comprising:

determining, in an automatic mode, the laundry cycle type regardless of input from a user interface; and using the laundry cycle type to wash the laundry load.

4. The method of claim 1, further comprising:

estimating the dry mass of the laundry load according to electrical load on a motor of the laundry appliance;

estimating the wet mass of the laundry load according to the dry mass and a first sump pressure recorded by a sump pressure sensor after adding the water and before spinning out the laundry load; and estimating the spun mass of the laundry load according to the dry mass and a second sump pressure recorded by the sump pressure sensor after spinning out the laundry load.

5. The method of claim 1, further comprising estimating the dry mass by:

receiving motor parameters from a motor of the laundry appliance during an initial dry spin of the laundry load before adding the water, the motor parameters including voltage, current, torque, and/or speed information; and using a machine learning algorithm to estimate the dry mass according to the motor parameters.

6. The method of claim 1, further comprising estimating the wet mass by:

providing the water into the drum by opening a value for a predefined amount of time, thereby providing a predefined quantity of water;

identifying a maximum recorded sump pressure of a sump pressure sensor after adding the water and before spinning out the laundry load; and identifying the wet mass based on an amount of retained water corresponding to the maximum recorded sump pressure as compared to the predefined quantity of water.

7. The method of claim 1, further comprising estimating the spun mass by:

receiving motor parameters from a motor of the laundry appliance during a spin of the laundry load after adding the water, the motor parameters including voltage, current, torque, and/or speed information; and using a machine learning algorithm to estimate the spun mass according to the motor parameters.

8. The method of claim 1, further comprising estimating the absorption ratio of the laundry load by:

computing a difference between a first sump pressure recorded for an empty laundry load and a second sump pressure recorded responsive to adding the water to the drum; and dividing the difference by the dry mass.

9. The method of claim 1, further comprising estimating the absorption ratio of the laundry load by:

computing a difference between the wet mass and the dry mass; and dividing the difference by the dry mass.

10. The method of claim 1, further comprising estimating the retention ratio of the laundry load by:

computing a difference between the wet mass before and after a spin to remove excess water; and dividing the difference by the dry mass.

11. The method of claim 1, further comprising applying one or more of clustering, principal component analysis, or a machine learning model to the measurements to determine the load parameters.

12. The method of claim 1, wherein the load parameters include density, volume, and/or fabric type of the laundry load.

13. The method of claim 1, wherein the laundry appliance is a washing machine, and further comprising sending the density, volume, fabric type, the dry mass, the wet mass, a retention ratio, and/or an absorption ratio of the laundry load to a dryer for controlling settings of the dryer.

14. The method of claim 1, further comprising reusing water from the pre-rinse cycle added into the drum to determine the load parameters to perform the laundry cycle type.

15. A method for inferring a laundry cycle type for a load of laundry items, comprising:

performing measurements of a laundry load in a drum of a laundry appliance during a pre-rinse cycle, the measurements including:

providing the water into the drum by opening a valve for a predefined amount of time, thereby providing a predefined quantity of water, measuring a time between adding the water and the water reaching a sump of the laundry appliance, identifying a maximum recorded sump pressure of a sump pressure sensor after adding the water and before spinning out the laundry load, identifying the wet mass based on an amount of retained water corresponding to the maximum recorded sump pressure as compared to the predefined quantity of water, receiving motor parameters from a motor of the laundry appliance during an initial dry spin of the laundry load before adding the water, the motor parameters including voltage, current, torque, and/or speed information, and using a machine learning algorithm to estimate the dry mass according to the motor parameters;

using a model to determine load parameters based on the measurements; and using the load parameters to determine a laundry cycle type for the laundry load.

16. The method of claim 15, further comprising:

receiving an input cycle type from a user interface of the laundry appliance;

proceeding with the input cycle type responsive to the input cycle type and the determined laundry cycle type being a match; and displaying a notification on the user interface responsive to a mismatch between the input cycle type and the determined laundry cycle type.

17. The method of claim 15, further comprising:

determining, in an automatic mode, the laundry cycle type regardless of input from a user interface; and using the laundry cycle type to wash the laundry load.

18. The method of claim 15, further comprising applying one or more of clustering, principal component analysis, or a machine learning model to the measurements to determine the load parameters.

19. The method of claim 15, further comprising using the laundry cycle type to wash the laundry load.

* * * * *